US005174606A

United States Patent [19]

Hure

[11] Patent Number: 5,174,606

[45] Date of Patent: Dec. 29, 1992

[54] END FLAP FILE FOLDER AND METHOD OF USE

[75] Inventor: Jean C. Hure, Versailles, France

[73] Assignee: Safeguard Business Systems, Inc., Fort Washington, Pa.

[21] Appl. No.: 806,681

[22] Filed: Dec. 13, 1991

Related U.S. Application Data

[63] Continuation of Ser. No. 599,202, Oct. 16, 1990, abandoned.

[51] Int. Cl.[5] ..... B42D 3/00

[52] U.S. Cl. ..... 281/45; 493/947; 40/359

[58] Field of Search ..... 283/67, 64, 116, 117; 281/3.1, 15.1, 29, 45; 493/947; 40/359

[56] References Cited

FOREIGN PATENT DOCUMENTS 1449885 8/1966 France ..... 40/359

2444571 8/1980 France ..... 40/359

*Primary Examiner*—Mark Rosenbaum

*Assistant Examiner*—Willmon Fridie, Jr.

*Attorney, Agent, or Firm*—Caesar, Rivise, Bernstein, Cohen & Pokotilow, Ltd.

[57] ABSTRACT

A file folder with an end flap attached to one side is disclosed. When the end flap is folded it allows for identification of the contents of the folder on one end of the folder. The folder is filed in open racks, transversely to the front of the racks, so that the identification on the end flap is exposed and visible. The end flap also lends strength and stability to the folder and prevents slippage of the contents of the folder when the folder is being handled and when the folder is filed. The folder is of unitary construction and has no pertruding tabs when folded for packing and shipment.

19 Claims, 2 Drawing Sheets

END FLAP FILE FOLDER AND METHOD OF USE

This application is a continuation of Ser. No. 07/599,202 filed Oct. 16, 1990, now abandoned.

BACKGROUND OF THE INVENTION

This invention relates generally to file folders and more particularly to a file folder having an end flap which protects the contents of the folder, and which allows the viewing of the folder identification at angles generally perpendicular to one end of the folder.

Various types of file folders are presently in use. In systems using file drawers, the file folders are inserted laterally, i.e., with the sides of the folder facing the front of the drawer. A tab, upon which identification of the file contents is placed, protrudes from the top of one side section of the file folder so that when the file drawer is opened the identification can be seen by the user.

Simple folders are made of heavy stock paper, such as manila paper. They are usually of unitary construction with one or more score lines between opposing side sections. If there is more than one score line, folding the file sections along selected score lines will change the width of the file.

Accordion file folders have opposing side sections to which are added accordion folded bottom and end sections, which allow the file to automatically expand as contents are added to the file. In these types of folders one section is usually made higher than the other section so that identification information can be placed on the inside surface of, and along the top of, the higher section.

Whereas simple folders comprising opposing side sections can be folded flat for shipment and storage, expandable files have an inherently larger thickness due to the accordion folded sections. Furthermore, expandable files are more expensive to produce since they are not of unitary construction. In addition to the stamping, scoring and folding operations required in the production of simple, unitary folders, expandable file folders also require gluing operations to produce.

In recent years it has been recognized that large filing systems using standard file cabinets, with roll out drawers, are highly inefficient. Space is wasted, because the aisles between file cabinets must be made wide enough to accommodate the full length of the drawer when it is pulled out during file storage or retrieval. Furthermore, the design of the file cabinets is complex because it must allow for extending the full length of the file drawer out of the file cabinet. This requires strengthening of the cabinet to allow for holding the cantilevered load when the file drawer is extended outward. Finally, because the cabinets must be sturdy and space allowed for the runners, and between the runners and the sides of the cabinets, additional space is required.

This loss of efficiency in space and the added complexity of construction have resulted in the advent of more efficient filing systems wherein the files are stored in open racks which are similar to library shelves. In this system the files are placed transversely to the front of the racks (end-to-end) rather than laterally (sidewise). Thus, one end of the file folder is placed against the closed, or partially closed, back of the rack, while the other end of the file is at the open front of the rack. In some designs, double racks are constructed back to back, with a stop panel between the racks, against which the files are placed.

Even greater efficiency with regard to space savings is obtained when the open racks are movable. The racks are placed on rails so that they can be mounted against each other with one aisle space for a large number of racks. By moving the racks on the rails, an aisle is created in front of the rack which holds the desired file folder for retrieval or for filing. With movable open racks and the other space savings discussed previously, over 50% of the required space can be saved as compared to using conventional file cabinets.

These moveable open racks used in filing systems are commonly fifteen inches deep and from fifteen to forty or more feet in length. Double racks of fifteen to twenty five feet in length can be moved on the rails using a manual chain pulley arrangement. For longer racks, the positioning system is electrically powered.

The open rack type of filing system requires identification of the files at the front end of the file folder rather than at the top. Thus, existing file folders have been modified to allow for an extending end tab attached to, and parallel to, one side section of the file. Also, since the front end of the file is exposed (as is not the case with standard file cabinets), there is a possibility that the contents of the files may spill out of the folder either when the folders are in place in the racks or when handling the folder, when placing it in the rack, or when removing it from the rack.

Identification on the tab in line with the back section of the folder requires viewing the folders at an angle because the identification can be blocked by other tabs if the line of sight is too closely parallel to the front edge of the rack. Also, if the line of sight is generally perpendicular to the front edge of the rack, the identification cannot be read because the tab is also perpendicular to the edge of the rack.

Thus, the need exists for a simple file folder which provides for easier viewing of the folder identifying information as well as protection to prevent spillage of the contents of the folder. Also, efficiency in storage, transportation and handling of file folders can be obtained if the folders are shipped without protruding tabs for holding identifying information.

OBJECTS OF THE INSTANT INVENTION

Accordingly, it is a general object of this invention to provide for a file folder which overcomes the disadvantages of the prior art.

It is a further object of the this invention to provide a file folder which is of unitary construction and can be packaged for shipment and storage without protruding tabs.

It is still a further object of this invention to provide a file folder with a means for preventing spillage of the contents of the folder during handling and when the folder is stored in a file.

It is still yet a further object of this invention to provide a file folder which can be easily and less expensively manufactured using standard stamping, scoring and folding equipment without the need for gluing operations.

It is another object of this invention to provide a file folder which provides protection for the contents of the file.

It is still another object of this invention to provide a file folder for open rack storage with a wider angle of view of the identification of the folder than is available with present folders.

SUMMARY OF THE INVENTION

These and other objects of the subject invention are achieved by providing a file folder with an end flap attached to one of the opposing side sections of the folder.

The folder is of unitary construction having two opposing side sections and a bottom section. An end flap is attached to one edge of one of the opposing side sections. Score lines placed in the bottom section enable changing the width of the bottom section to accommodate varying amounts of contents placed in the folder. The end flap has a end section and a flap extension. By folding the end flap at selected score lines, the width of the end section can be varied and the end flap folded so that the flap extension lies in a plane parallel to the opposing side sections of the folder. Thus the contents may be placed in the space created between one of the side sections, the end section, and the flap extension.

When the folder is stored in filing systems using open ended racks, similar to those used for library shelving, easy viewing of the identification information is obtained by placing the information on the end section. Furthermore, the end flap prevents spillage, and protects the contents of the folder when the folder is filed in open racks or on shelving.

DESCRIPTION OF THE DRAWING

Other objects and many of the attendant advantages of this invention will be readily appreciated when the same becomes better understood by reference to the following detailed description when considered in connection with the accompanying drawing wherein.

DETAILED DESCRIPTION OF THE PREFERRED EMBODIMENTS

Figure 1:
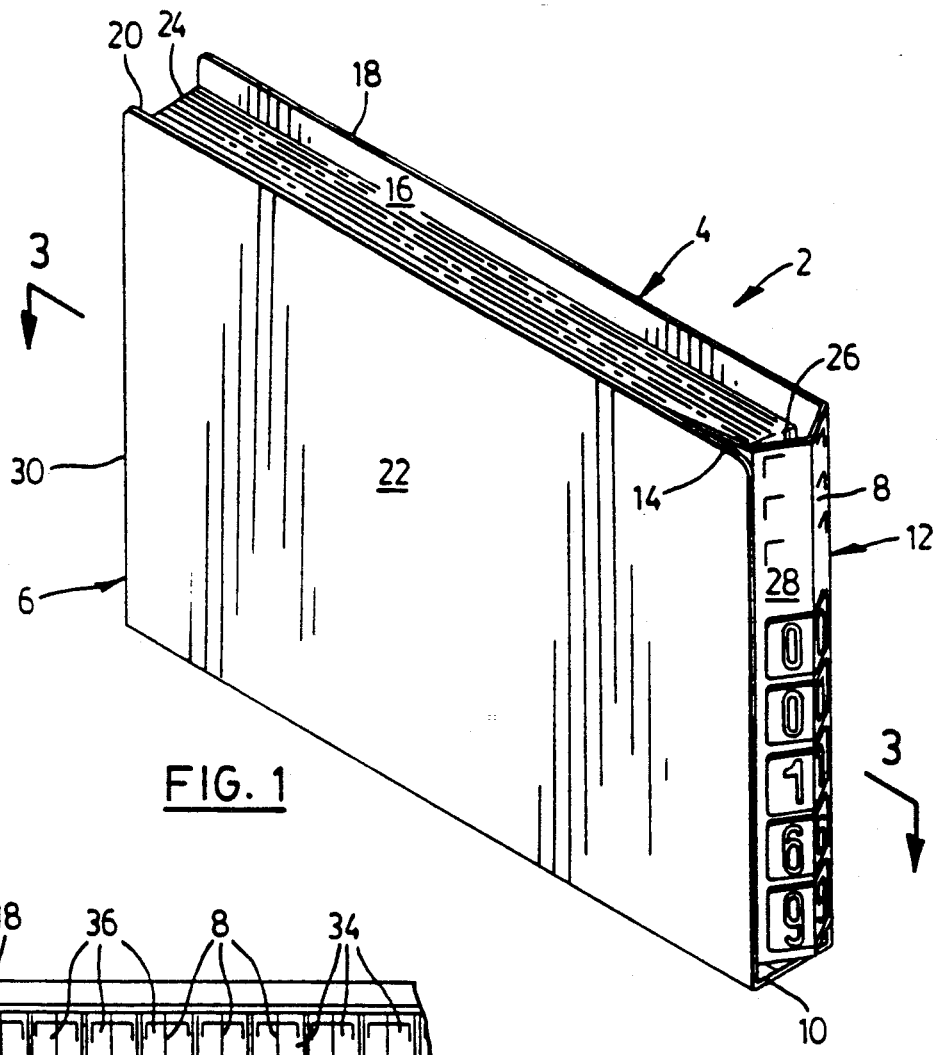
FIG. 1 is a perspective view of the file folder constructed in accordance with this invention and showing identifying information placed on the end section of the folder.

Referring now in greater detail to the drawing, where like characters refer to like parts, there is shown at 2 in FIG. 1 a file folder constructed in accordance with this invention. The folder 2 has opposing side sections 4, and 6, a bottom section 10 and an end flap 12.

Figure 2:
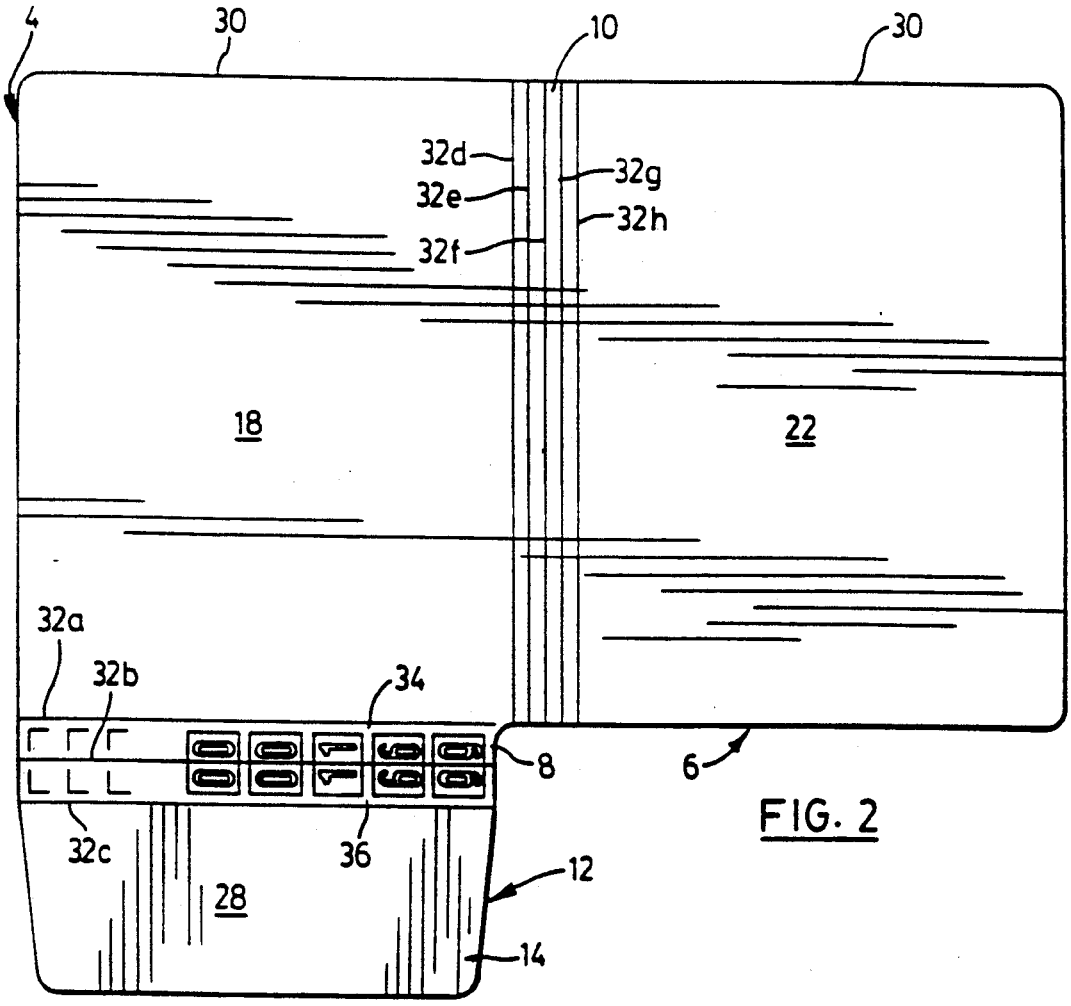
FIG. 2 is a top plan view of a blank forming the file folder showing the unitary construction of the file folder with score lines for creating the side, bottom and end sections of the folder.

FIG. 2 shows the unitary construction of the folder. The outside surfaces 18, 22, and 28 of the side section 4, the side section 6, and the end flap 12, respectively, are shown face up. Score lines 32*a*–*c* enable folding of the end flap and score lines 32*d*–*h* enable folding of the side sections to create bottom section 10. The end flap 12 comprises an end section 8 and a flap extension 14.

The folder may be constructed of standard heavy weight or manila paper and can be manufactured using standard types of stamping, scoring, and folding equipment.

As can be seen in FIG. 2, the file folder may be folded on the score line 32*f* creating outside surfaces 18 and 22. Furthermore, the end flap 12 can be folded along the score line 32*a* so that the end flap 12 abuts the inner surface 16 of the side section 4. When folded as above, the side sections 4 and 6 abut each other and the folders are rectangular in shape without protruding tabs or sections. They therefore require less storage space and can be efficiently packaged, stored, transported and handled.

As can be seen in FIG. 2, the width of the bottom section 10 and the end section 8 can be varied by selecting the proper score lines for folding. In FIGS. 1 and 3*b* the folder has been folded for maximum capacity. The width of the bottom section 10 has been maximized by folding the side section 4 along the score line 32*d* and the side section 6 along the score line 32*h*, until the planes of the sections 4 and 6 are parallel to each other and perpendicular to the plane of the bottom section 10. As shown in FIGS. 1, 2 and 3*b*, to accommodate this width, the flap extension 14 is folded along the score line 32*c*. Thus the first segment 34 and the second segment 36 of the end section 8 enclose one end of the file folder 2. The flap extension 14 is positioned to be parallel to, and abut, the inner surface 20 of the side section 6.

As can be seen in FIG. 1, contents 24 may be placed in the folder between the inner surfaces 16, 20, and 26 of the side section 4, the side section 6, and the end section 8, respectively.

Figure 4:
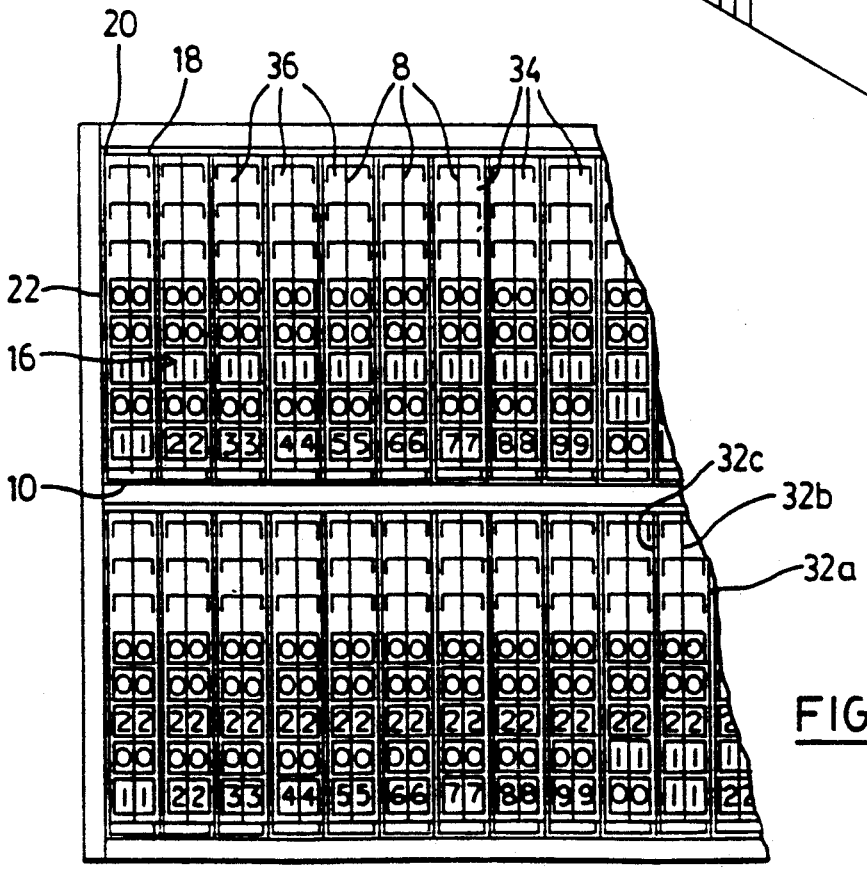
FIG. 4 is a partial front elevational view of an open rack filing system with the folders of the instant invention filed therein.

FIG. 4 shows the file folder 2 placed in open racks. When open rack filing systems are used, the file folders are placed into the racks with one end of the folder abutting the rear of the rack and the other end of the folder facing outward at the open end of the rack, in a manner similar to the storage of books on book shelves, as was previously explained. Thus, distal edges 30 of the side sections 4 and 6 are placed inwardly in the rack against the rear of the rack while the proximal edges of the sections, with the end section 8 facing outward, are at the open end of the rack.

With previously existing folders, end tabs are used to provide identifying information for the folder. This results in loss of efficiency in packing, storing and transporting the folders. Furthermore, the identifying information can only be viewed at angles between parallel to the front edge of the rack and perpendicular to the front edge of the rack. If the line of sight is close to parallel to the front of the rack, other identifying tabs will hide the information on the folder which is to be located. Also, since these tabs are in a plane parallel to the planes of the side sections 4 and 6, the identifying information on the tab cannot be viewed head on. However, as can be seen in FIGS. 1, 2, and 3*b* the first segment 34 and the second segment 36 of the end section 8 are angled between the planes parallel to the side sections and the plane perpendicular to the side sections. Thus, the identifying information on the segments 34 and 36 can be seen over a much wider range of angles than with existing identifying tabs, from head on viewing all the way to viewing almost parallel to the edge of the filing rack.

Figure 3A:
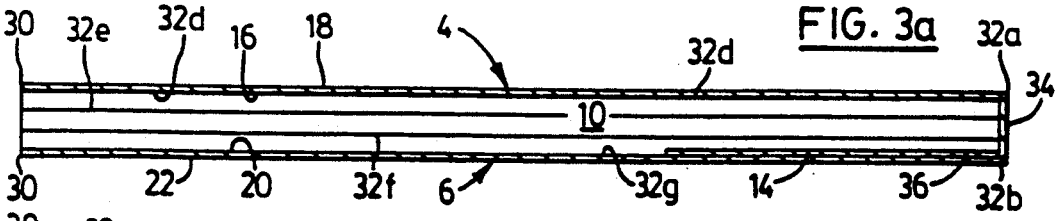
FIG. 3*a* is a sectional view taken along the line 3—3 of FIG. 1, with the contents of the file removed, which shows the end flap folded at a score line which creates an end section whose plane is generally perpendicular to the planes of the back and front sections.
Figure 3B:
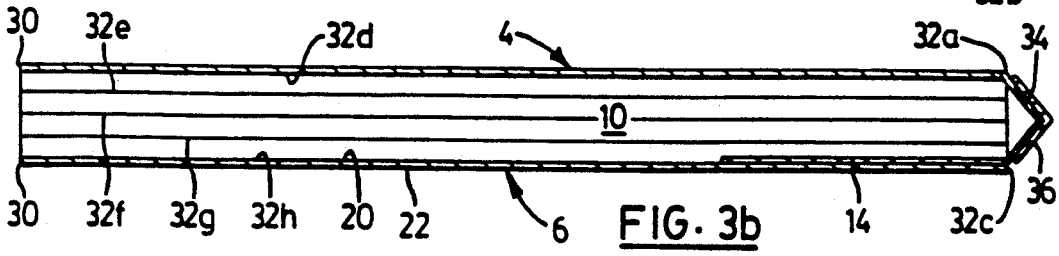
FIG. 3*b* is a sectional view taken along the lines 3—3 with the front and back sections folded at score lines which create a wider bottom flap and the end flap folded at score lines to accommodate the wider bottom section.

If less capacity is required for the file folder 2, it may be configured as shown in FIG. 3*a*. Here, the width of the bottom section 10 has been reduced as compared to the width of the bottom section in FIG. 3*b* by folding the side section 4 along the score line 32*d* and the side section 6 along the score line 32*g*. End flap 12 has been folded at the score line 32*a* and at the score 32*b*. Thus, the first segment 34 has been folded into a plane perpendicular to the planes of sections 4 and 6. The second segment 36 and the flap extension 14 are positioned to abut the inner surface 20 of the side section 6 in a plane parallel to the plane of the side section 6.

Although the folder has been described as having the end flap 12 attached to the side section 4 it is clear that the end flap 12 can just as well be attached to the side section 6 to provide the functions of the folder.

Spillage of the contents of the file folder 2 is prevented by end section 8 when the folder is stored in the filing racks. Moreover, the end section 8 and the flap extension 14 provide protection of the contents of the folder from damage. They also provide structure and stability to the folder which is not present with folders which consist only of opposing side sections without end flaps. It should be noted here that accordion type folders provide protection and stability as well. However, they are expensive to produce requiring additional material and gluing operations and identification cannot be put on the end sections of the accordion types of folders.

It is also important to note that this invention, with its improvements over existing file folders, may be used with any type of shelving, in addition to the open racks described above, as well as on flat surfaces with book ends or their equivalent.

A file folder has been described which provides for easier viewing of content identification, protection of the contents of the folder, and prevention of spillage of the contents of the folder when the file folders are stored in open racks or on shelving.

Without further elaboration the foregoing will so fully illustrate my invention that others may, by applying current or future knowledge, adapt the same for use under various conditions of service.

I claim:

1. A file folder comprising a unitary folded sheet with:

(a) first and second opposing side sections, each having a proximal edge, a distal edge and a bottom edge;

(b) a bottom section connected to said side sections at said bottom edges; and (c) a single flap for protecting the contents of said folder, for preventing spillage of the contents of said folder when said folder on at least one plane positioned at an angle to the planes of said first and second opposing side sections and for strengthening the structures of said folder when said folder is in use, said end flap for insertion of opposing side section forming a pocket for insertion of documents, said pocket comprising a side formed by said first opposing side section, a bottom formed by said bottom section and another side formed by said single flap.

2. The folder of claim 1 wherein said single flap comprises an end section connected to said first opposing side section and a flap extension connected to said end section.

3. The folder of claim 2 wherein said flap extension lies in a plan which is generally parallel to the planes of said side sections and said end section lies in at least one plane which is at an angle to the planes of said side sections so that when said contents are placed in the space between said flap extension and said end section, the contents are protected, spillage is prevented when the folder is placed in an open rack and the folder is strengthened.

4. The folder of claim 3 further comprising means to expand or contract the capacity of said folder.

5. The folder of claim 4 wherein said expanding and contracting means comprises score lines on said bottom section for changing the width of said bottom section by folding said side sections along selected score lines, with the planes of said side section laying generally perpendicular to the plane of said bottom section.

6. The folder of claim 5 wherein said expanding and contracting means further comprises score lines of said end section for changing the width of said end section by folding said end section along selected score lines.

7. The folder of claim 2 wherein said end section lies in a plane which is approximately at a 90 degree angle to the planes of said side sections.

8. The folder of claim 2 wherein said end section comprises a first and a second segment, each of said segments laying in a plane which is between 0 and 90 degrees to the planes of the side sections.

9. The folder of claim 7 further comprising identifying material placed on said end section.

10. The folder of claim 8 further comprising identifying material placed on at least one of said segments of said end section.

11. The folder of claim 1 further comprising means to expand or contract the capacity of said folder.

12. The folder of claim 11 wherein said expanding and contracting means comprises score lines of said bottom section for changing the width of said bottom section by folding said side sections along selected score lines, with the planes of said side sections laying in planes which are generally perpendicular to the plane of said bottom section.

13. A file folder comprising a unitary folded sheet with:

(a) first and second opposing side sections, each having a proximal edge, a distal edge and a bottom edge;

(b) a bottom section connected to said side sections at said bottom edges; and (c) a foldable end flap for protecting the contents of said folder, for preventing spillage of the contents of said folder when said folder is filled or handled, for identifying the contents of said folder on at least one plane position at an angle to the planes of said first and second opposing side sections and for strengthening the structure of said folder when said folder is in use, said end flap attached to said first opposing side section forming a pocket for insertion of documents, said pocket comprising a side formed by said first opposing side section, a bottom formed by said bottom section and another side formed by said end flap, said folder further comprising means to expand or contract the capacity of said folder, said expanding and contracting means comprising score lines on said bottom section for changing the width of said bottom section by folding said side sections along selected score lines, with the planes of said side sections laying in planes which are generally perpendicular to the plane of said bottom section, said end flap further comprising an end section and a flap extension and said expanding and contracting means further comprising score lines on said end section for changing the width of said end section by folding said end section along selected score lines.

14. The folder of claim 13 wherein said end section lies in a plane which is approximately at a 90 degree angle to the planes of said side sections.

15. The folder of claim 14 wherein said end section comprises a first and a second segment, each of said segments laying in a plane which is between 0 and 90 degrees to the planes of the side sections.

16. A method for filing material on shelving utilizing a file folder having opposing first and second side sections, a bottom section, and a single flap attached to said first side sections, all of said sections having inside and outside surfaces, said method comprising the steps of:

(a) folding said side sections so that said side sections lie in planes which are perpendicular to the plane of said bottom section;

(b) folding said single flap so that said flap extension is parallel to and abuts the inside surface of said second side section, and said end section lies in at least one plane at an angle to the planes of said side sections to form a pocket with sides formed by said inside surfaces of said first side section, said end section, said flap extension and said bottom section;

(c) placing said material within said pocket; and (d) placing said file folder onto said shelving transversely to the longitudinal direction of said shelving with said end section visible.

17. The method of claim 16 further comprising the step of placing identifying information on said end section.

18. The method of claim 17 wherein said folder further comprises score lines and said method further comprises the steps of folding said side sections and said single flap said score lines.

19. The method of claim 18 further comprising the step of expanding or contracting the capacity of said folder by folding said side sections and said end flap along selected score lines.

* * * * *